US005090485A

United States Patent [19]

Pomonik et al.

[11] Patent Number: 5,090,485

[45] Date of Patent: Feb. 25, 1992

[54] PILE DRIVING USING A HYDRAULIC ACTUATOR

[76] Inventors: George M. Pomonik, 4144 Meadowlark Dr., Calabasas, Calif. 91302; Robert Geminder, 27935 Ambergate Dr., Rancho Palos Verdes, Calif. 90274; Orlando J. Gonzalez, 571 35th St., Manhattan Beach, Calif. 90026

[21] Appl. No.: 79,715

[22] Filed: Jul. 30, 1987

[51] Int. Cl.[5] ..... E21B 7/00

[52] U.S. Cl. ..... 173/1; 173/20

[58] Field of Search ..... 173/1, 20, DIG. 4; 405/232, 247

[56] References Cited

U.S. PATENT DOCUMENTS

| | | | |
|---|---|---|---|
| 4,058,175 | 11/1977 | Holland | 173/1 |
| 4,377,355 | 3/1983 | Chelminski | 173/1 |
| 4,534,419 | 8/1985 | Vural . | |
| 4,574,888 | 3/1986 | Vogen . | |
| 4,653,593 | 3/1987 | Lindberg | 173/1 |

FOREIGN PATENT DOCUMENTS

| | | | |
|---|---|---|---|
| 25517 | 3/1981 | Japan | 173/20 |

*Primary Examiner*—Timothy V. Eley
*Assistant Examiner*—Willmon Fridie, Jr.
*Attorney, Agent, or Firm*—Arthur Freilich; Robert D. Hornbaker; Leon D. Rosen

[57] ABSTRACT

A system is described for efficiently driving a pipe or pile into the ground. The resonant frequencies of the pile are determined, and a hydraulic actuator is controlled to apply a series of time-spaced shocks to the top of the pile, where each shock has a duration and form tuned to maximize the response at a given resonance. Such shocks result in a greater velocity of the pile at its lower end, than from very short duration shocks such as those of a hammer. In certain soils the hydraulic actuator applies resonant continuous sinusoidal vibrations to the pile, and, upon completion of installation, a refusal test of the installed pile is conducted by applying very brief and spaced shocks by the actuator that simulates hammer blows. Underwater pile driving by a hydraulic actuator avoids the need for additional special watertight structures for the apparatus. An underwater reaction mass equivalent is obtained by coupling an underwater collar or sail to the actuator, where the collar uses water resistance, in the form of hydrodynamic added mass and damping, to resist vertical motion. Integral with the system is relatively simple instrumentation which yields mechanical independence, and other in situ data, which provides information on actual down hole field conditions, and thus allows more efficient utilization of the equipment.

10 Claims, 2 Drawing Sheets

FIG. 1
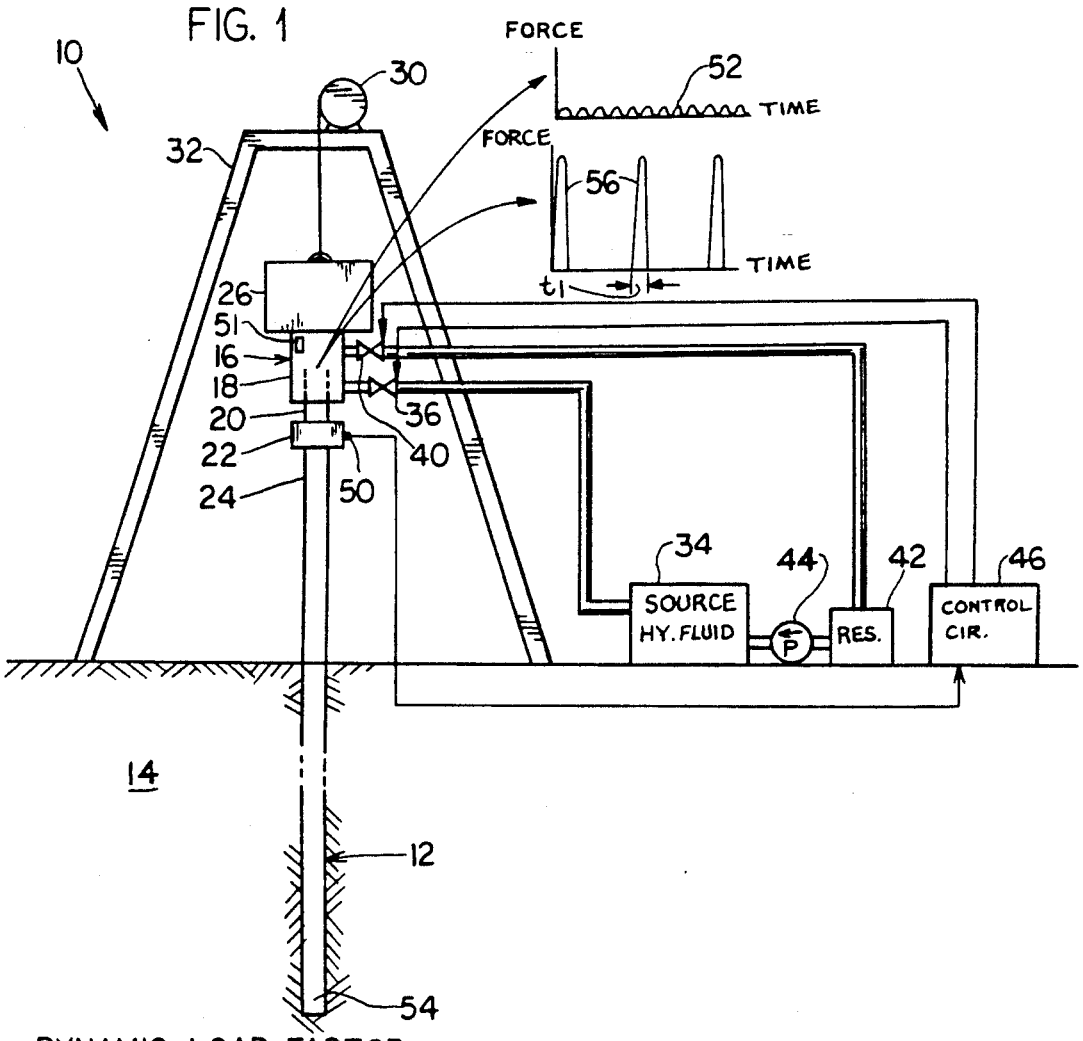
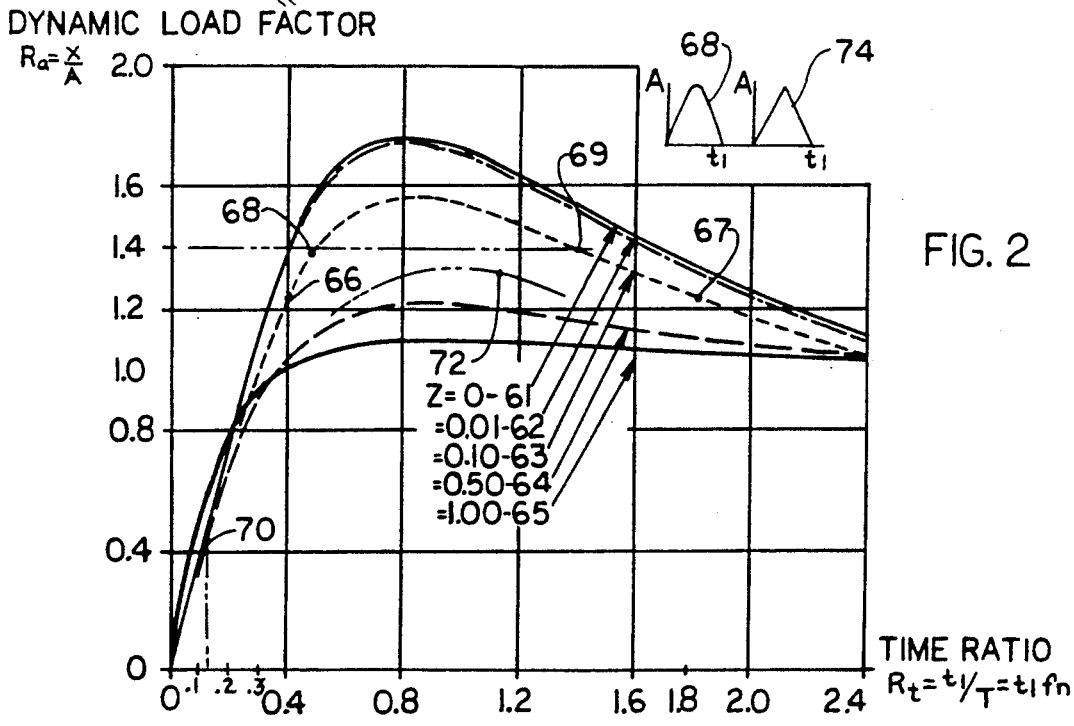
FIG. 2

FIG. 3
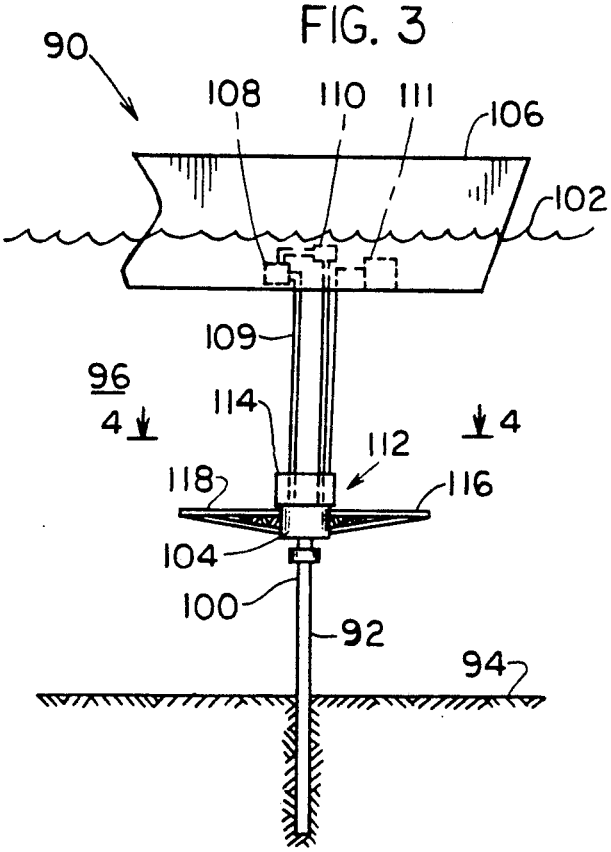
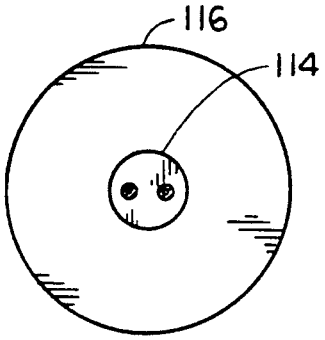
FIG. 4
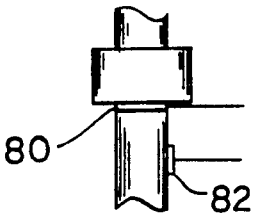
FIG. 5
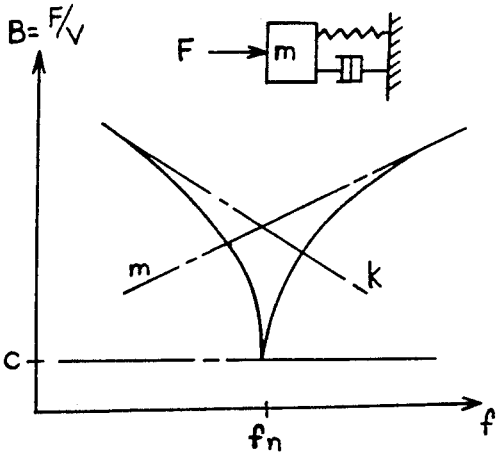
FIG. 6

PILE DRIVING USING A HYDRAULIC ACTUATOR

BACKGROUND OF THE INVENTION

Pipes or piles can be driven into the ground using a variety of techniques, including applying hammer blows from a mechanical hammer or a hydraulically powered actuator, or by applying vibrations to the pile at a frequency close to a resonant frequency of the pile by rotating counterweights or a hydraulic actuator. The application of continuous vibrations is often superior in soils that permit such driving, but hammer blows are resorted to when such vibratory driving does not result in pile penetration of the soil. A technique which provided some of the advantages of vibratory driving, of obtaining a large driving velocity at the lower tip of the pile for a given force application at the upper end, but which could be used when spaced and efficient shocks must be applied to the pile to penetrate difficult soil, and also simulated a conventional refusal test after installation, would be of considerable value. Reference to a pile shall also be understood to apply to a pipe, conductor or any structural member or conduit which is installed in the earth.

SUMMARY OF THE INVENTION

In accordance with one embodiment of the present invention, a method and apparatus are provided for application to a pile, which enables more efficient movement of the pile. A pile driven by a series of shocks applied to its upper end at spaced times is more effectively driven by using shocks that are each of an amplitude, shape, and duration which are tuned to maximize the response of a given pile resonance. Where the ratio of critical damping of the pile is less than 0.5, each shock preferably has an amplitude-time profile somewhat similar to that of a half sinewave, and the duration of each shock is preferably about 80% of the undamped natural period of the selected resonance (usually the lowest) of the pile.

A hydraulic actuator can be used to apply either vibrations or shocks. When such an actuator is used to apply vibrations to drive the pile, refusal testing of the pile can be accomplished by applying shocks of very brief duration simulating those of hammer blows.

In underwater pile driving, a hydraulic actuator is used which lies underwater. Part of the effective reaction mass is provided by a collar or sail which utilizes hydrodynamic forces to react to the dynamic forces of the driver.

The novel features of the invention are set forth with particularity in the appended claims. The invention will be best understood from the following description when read in conjunction with the accompanying drawings.

BRIEF DESCRIPTION OF THE DRAWINGS

FIG. 1 is a simplified side elevation view of a pile driving apparatus constructed in accordance with the present invention.

FIG. 2 is a shock spectra graph showing variation in the dynamic load factor with the time ratio, and can be used to approximate the effects of shocks applied to the pile of FIG. 1.

FIG. 3 is a side elevation view of a pile driving apparatus constructed in accordance with another embodiment of the invention.

FIG. 4 is a view taken on the line 4—4 of FIG. 3.

FIG. 5 is a partial side elevation view of test apparatus useful with the apparatus of FIG. 1, for measuring the ratio of critical damping and other physical characteristics of the pile of FIG. 1.

FIG. 6 is a curve showing variation in mechanical impedance with frequency for a typical single degree-of-freedom system.

DESCRIPTION OF THE PREFERRED EMBODIMENT

FIG. 1 illustrates a system 10 for driving a pipe or pile 12 into the earth 14. The system includes a hydraulic actuator 16 formed by a cylinder 18 and a piston 20. The piston 20 is coupled through a pipe attachment 22 to the upper end 24 of the pile to apply forces to the pile. A reaction mass 26 is coupled to a side of the actuator opposite the pile. The mass can be raised or lowered by a winch 30 mounted on a support 32. The winch controls the dead weight (the portion of mass 26) on the pile during operation; the winch can also be designed to help isolate the support 32 from the dynamic loads in the system.

The actuator 16 is energized by a source of pressured hydraulic fluid 34 which is coupled through an inlet valve 36 to the actuator to supply pressured hydraulic fluid thereto. Additional intermediate valves, controls and hydraulic accumulators may be integral with the actuator in order to increase its controllability, efficiency, and range. Fluid from the actuator passes out through an outlet valve 40 to a reservoir 42, which is coupled through a pump 44 to the source 34. The valves 36 and 40 are closely controlled by a control circuit 46. An amplitude transducer 51 is part of the actuator control system. A feedback transducer 50 is also coupled to the circuit 46, and is used to determined resonant frequencies of the pile 12, which varies with its penetration and contact of its sides with the surrounding earth.

When pile driving into certain types of ground material such as sand, it is desirable to drive with continuous vibrations, as by controlling the valves 36, 40 so that the force applied by the piston 20 to the top of the pile varies sinusoidally, is indicated by the graph 52. The frequency of the vibrations 52 is preferably equal to a resonant frequency of the pile which results in maximum amplitude of vibrations at its lower end 54. The lowest resonant frequency is generally preferred because this results in the greatest amplitude of vibration of the pile bottom, although higher resonant modes can be applied. In the absence of restraints and masses on the pile, the resonant frequency $f_n$ equals nc/2L where n is the mode number, c is the velocity of sound in the pile, and L is the length of the pile. The second or third lowest resonant frequencies can sometimes be advantageous in providing antinodes within the soil that contains the lower portion of the pile. Resonant modes above the third lowest are seldom useful. Interactions of the soil and the pile and structures attached thereto alter the resonant frequencies of the system, so in situ measurements are necessary.

In certain kinds of soils such as clay, it is found that vibrations applied to the pile generally result in no movement of the pile. In that case, high amplitude spaced shocks such as shown by graph 56 are applied. It can be seen that the time between spaced shocks is greater than the duration of each shock. Such spaced high amplitude shocks are somewhat similar to the blows of a hammer applied by prior art hammer drivers.

One problem encountered with applying high amplitude shocks is that is the shocks exceed a certain level, they may damage the upper end of the pile. Applicant closely controls the shocks 56 to obtain maximum driving at the lower end 54 of the pile for shocks of given energy value and whose maximum amplitude is low enough to avoid damage to the top of the pile.

The shock spectrum illustrated in FIG. 2 is often used in describing the damage potential, or response-inducing potential, of a given shock pulse. The shock spectrum is derived by determining the maximum responses of a series of single degree-of-freedom systems (with given damping) to the shock pulse, and plotting these responses as a function of frequency. In one form, the acceleration shock spectrum is nondimensionalized by plotting X/A (the ratio of peak response acceleration X to peak input shock acceleration A) versus $f_n t_l$ (the response natural frequency $f_n$ times the input shock period $t_l$). The relationship of these quantities is given by:

$$f_n t_l = t_1/T$$

where T is the undamped natural period equals $1/f_n$. The shock spectrum can be used to understand the response of complex multiple degree-of-freedom systems (e.g., normal mode superposition can be used to calculate the response of a complex linear structure). For the pile driving application, the shock spectrum technique can be used to approximately characterize the response of a given resonance in the pile system.

In accordance with one embodiment of the present invention, applicant controls the shocks 56 applied to the upper end of the pile, so each has a duration $t_l$ selected to maximize the response of a given resonance in the pile. FIG. 2 includes shock spectra graphs 61–65 showing the variation in dynamic load factor X/A with the time ratio of applied shocks of the type shown at 68. The dynamic load factor $R_a$ is the ratio of acceleration X of the lower end of a pile for a given acceleration A of the upper end of the pile by the actuator. The time ratio $R_t$ equals the duration $t_l$ of the shock, divided by the undamped natural period T. The time ratio $R_t$ can also be given by:

$$R_t = t_l f_n$$

where $f_n$ is the undamped frequency of the pile, which is approximately the frequency at which maximum displacement occurs at the lower end of the pile for a given energy of vibration applied to the upper end of the pile.

The graphs 61–65 show the variation in dynamic load factor with the ratio of critical damping Z. A Z of 1.00 represents the minimum damping to cause the oscillator to return to its quiescent position after a displacement, with no oscillation. Z is the ratio of the actual damping coefficient to the critical damping coefficient. In a typical pile driving situation, Z may range from approximately 0.05 to less than 0.20, at a given resonance. As an approximation, it can be seen from FIG. 2 that for a typical pile resonance having a Z of about 5%–10%, the response of the pile resonance can be maximized for a given shock at the top end of the pile, by applying shocks of a duration of about 0.8 of the undamped natural period of the resonance. A significant increase in the ratio $R_a$ of over 20% can be achieved for the case where Z is less than 0.10 (e.g., curves 61–63), by using a time ratio $R_t$ of between about 0.4 and 1.8 (between points 66 and 67); an increase of at least about 40% can be achieved for an $R_t$ between about 0.5 and 1.4 (points 68, 69).

For long piles and piles with very long followers for subsea installations, where pile driving is most difficult and the present invention has the greatest utility, the lowest resonant frequency could be in the range of about 5 Hz to 25 Hz (corresponding to lengths of approximately 1600 feet to 300 feet). Even for a resonant frequency of 25 Hz, the preferred duration of the pulse is about 0.032 seconds. This may be compared with a duration of a pulse from a typical prior art hammer which includes a weight that either falls or is pushed by steam downwardly to strike the top of the pile, and where the duration of the pulse is about 0.005 second. A shock duration of about 0.005 second is significantly less than the optimum duration even for a long pile with a high (25 Hz) fundamental resonant frequency. In any case, the hammer blow duration is not closely controlled, while applicant's shocks are closely controlled.

In FIG. 2, such a duration of 0.005 second is indicated at point 70 for a resonant frequency of about 25 Hz. At point 70, the response of the first resonance of the pile is only about 40% of the applied shock amplitude at the upper end of the pile, and (for Z=0.1) is about one-fourth the optimal response obtainable by application of a pulse of longer duration, with the same maximum amplitude. For $R_t$ below 0.2 we are in an "impulse region" when $R_a$ is approximately linear and equal to $4R_t$. Therefore, for a shock pulse of 0.005 seconds, the response of the first resonance in our example would decrease proportional to the decrease in resonant frequency. It might be thought that even with a relatively lower ratio $R_a$, larger response could be achieved by increasing the force with which the hammer strikes the top of the pile. However, above a certain maximum amplitude of shock, the top of the pile would become damaged. By driving the pile with a pulse of the proper duration so the dynamic load factor $R_a$ is a maximum, a given shock amplitude can be applied to the top of the pile which is less than that which would damage the top of the pile, and which takes advantage of the dynamic response of the pile, for the fastest pile driving.

The shape of the shock applied to the top of the pile also influences the response. The graph 72 indicates the dynamic load factor for a triangular shock having a shape shown at 74, for a Z of 0.10. This can be compared with the graph 63 for a sinusoidal wave 68. The ratio $R_a$ is lower for the triangular pulse than for the sinusoidal pulse. Therefore, alternate pulse shapes may be considered in order to improve performance for the specific field conditions encountered. Note that these examples are only intended to illustrate the value of the invention; actual field operation will be affected by many different conditions and thus actual field responses will differ from these relatively simply analytical examples. However, this invention provides the flexibility to evaluate actual field conditions, as well as adjust input shock (or vibration) conditions accordingly, in order to optimize the pile installation process.

A resonant frequency of the pile can be determined in a number of ways. One way is to apply sinusoidal waves to the top of the pile at a frequency that sweeps or progressively changes, as from 0.5 Hz to 300 Hz, and to measure the amplitude of vibrations of the top of the pile, with the frequency at which the amplitude of vibrations is greatest being the resonant frequency of the pile. Another way is to apply a shock at the top of the pile and to measure the resonant frequency-dependent vibrations of the pile. Techniques for accomplishing this are well known. A measurement is made after each shock is applied, so the changing resonant frequency of the pile can be monitored and the duration of the pulses can be maintained for optimal response. The transducer 50 (FIG. 1) can sense such vibrations, and the circuit 46 can be constructed to determine the resonant frequency after each shock according to the frequencies of vibrations of the pile which are of the greatest amplitude.

When piles are fully driven into the earth, as by continuous sinusoidal vibrations or otherwise, it is often necessary to test the piles to determine that they will resist further movement into or out of the earth. Tests developed many years ago, and which have been found to be reliable, generally referred to as refusal tests, often include applying hammer blows to the installed pile and measuring the ability of the pile to resist further downward movement as the result of such blows. Applicant's hydraulic actuator enables such refusal tests to be made without the need to install such a separate hammer device. Instead, the actuator 16 is driven so that it produces very short pulses, to simulate hammer blows.

A convenient method for measuring the resonant frequencies of the pile involves determining the mechanical impedance of the pile. This can be accomplished, as shown in FIG. 5, by measuring the force applied to the top of the pile by the actuator, by use of a force transducer 80, and by measuring the velocity of the top of the pile as sensed by an accelerometer or velocimeter 82 coupled to the top of the pile. Mechanical impedance is defined as the ratio of force to velocity, as a function of frequency, during simple harmonic motion. Mechanical impedance B is a complex quantity expressed in terms of both magnitude and phase angle versus frequency as is expressed by:

$$B=F/V$$

where F is the force applied and V is the velocity at the point of force application. The concept is particularly valuable in understanding a vibrating system because the mechanical elements (masses, springs, dampers, uniform bars) of that system can be expressed as impedance elements and combined into networks (similar to electrical circuit arrangements) which can be readily analyzed. For the pile driving application, analytical models are invaluable for purposes of designing and sizing the equipment initially, and then understanding and optimizing the actual field operations. The difficulty in developing accurate analytical models is the variation in parameters due to the uncertainty and variability of actual specific field conditions. Therefore, in situ measurements which yield information on the values of the parameters are particularly important in increasing the effectiveness of field operations.

Mechanical impedance can be measured in the field through the use of the following items: a sinusoidal force generator (provided by the actuator 16 in FIG. 1), a force transducer 80 (FIG. 5), a motion transducer 82 (FIG. 5), (to indicate displacement, velocity, or acceleration), and equipment for calculating instantaneous force F divided by velocity V and recording and/or displaying the data (provided by control circuit 46 in FIG. 1). The value of the impedance data thus obtained is that the impedance plot provides specific information about the actual mechanical impedance elements of the vibrating system. For example, FIG. 6 shows the magnitude of impedance versus frequency (on a log-log graph) for a simple single degree-of-freedom system. The actual values of natural frequency $f_n$, mass M, stiffness K, and damping c can be read directly from the graph. In a similar manner, information can be obtained during an actual pile installation operation using this invention. There are two important advantages in using this technique and apparatus together. A first is that the same equipment used for making in situ mechanical impedance measurements can be used for pile installations using vibrations and low shock, all without making any equipment changes. The second advantage is that the use of this equipment with mechanical impedance techniques allows downhole conditions to be understood, thus allowing operations to be optimized using simple instrumentation mounted only at the top of the pile. Other measurement schemes (e.g., the ratio of bottom motion to top motion) would involve complex, expensive, and unreliable instrumentation.

One method for determining resonant frequencies of a pile lying partially in the ground is to apply vibrations to the top of the pile and to sweep the frequency through a range such as from 0.5 Hz to 300 Hz. Instead of just trying to sense the amplitude of vibrations of the pile, the mechanical impedance of the pile is determined to enable a more precise determination of resonant frequency. This is accomplished by measuring both the force F (root mean square or other average) applied to the pile and the velocity (root mean square or other average) of the pile at the point of force application, with impedance B given by $B=F/V$. The equipment of FIG. 5 can be used. The frequency or frequencies where B is a minimum, as indicated in FIG. 6, is a resonance of the system.

FIG. 3 illustrates another pile driving system 90 wherein a pile 92 is to be driven into the floor 94 of a sea, with the upper end 100 of the pile lying below the surface 102 of the sea. The most common types of pile driving equipment include hammers and rotating counterweights. Both of such common pile driving devices would have to be specially enclosed and sealed to enable their use underwater. Applicant's use of a hydraulic actuator 104 that lies underwater and against the top of the pile, avoids the need for special enclosures, since all moving parts of hydraulic actuators (except for the protruding end of the piston which is generally of constant cross section) are sealed, and therefore no additional sealing is generally required. A floating (or fixed) platform 106 is provided at the sea surface, which includes a source 108 of pressured hydraulic fluid coupled through a hose 109 to the actuator. A reservoir 110 for receiving hydraulic fluid from the actuator is also located on the floating platform. The control circuit 111 which controls valves at the actuator is also located on the floating platform.

When the hydraulic hose 109 is very long, and thus losses are large, the hydraulic power source 108 can be alternatively located underwater and powered electrically via cables from the surface. Similarly, hydraulic reservoirs, controls, accumulators, etc., can also be located at or near the subsea actuator, thus keeping the hydraulic hose or pipe line short and improving the efficiency and effectiveness of the operation.

A reaction mass means 112 for reacting the dynamic forces of the hydraulic actuator when it acts on the pile, is provided by a small reaction mass 114 and a large collar or sail 116. The collar 116 comprises a large area member 118 oriented to interact with the surrounding water when it is moved vertically. Such a collar can be of relatively low weight and still provide considerable resistance to the dynamic movement of the actuator.

An equivalent added mass is provided by a hydrodynamic force proportional to the acceleration of a submerged body. The added mass $M_A$ of a circular disk moving perpendicular to its plane is expressed by:

$$M_A = \frac{8}{3} m R^3$$

where m is the mass density of sea water (approximately 2 slugs/ft$^3$) and R is the radius of the disk. Therefore, a disk with a 5 ft radius would have $M_A = 667$ slugs (equivalent to a weight of 21,000 pounds in air) and for a 10 foot radius $M_A = 5333$ slugs (equivalent to 172,000 pounds). It can be seen that significant reactive mass is obtained with the collar, without the need to handle and hoist the very heavy weight in air that would occur if an equivalent solid structure were used instead of hydrodynamic added mass. The cross-sectional area of the collar as seen in a plan view, is preferably a plurality of times greater than the diameter of the hydraulic cylinder or any other part rigidly attached thereto.

Thus, the invention provides a method and apparatus for driving a pile which is highly effective. Where a series of time-spaced shocks are to be applied to the top of the pile to drive it, the duration of the shocks is adjusted to produce optimal results. A hydraulic or electromagnetic actuator can be used to closely control pile driving, and to allow continuous vibration of the pile where the soil permits such driving. The same actuator can be used to conduct a refusal test which is based upon additional displacement of a driven-in pile by hammer blows, by activating the actuator to simulate such hammer blows. Such an actuator can be used to drive an underwater pile by placing the actuator underwater against the top of the pile, which avoids the need for special sealed enclosures. The reaction mass means may includes a collar oriented to produce a hydrodynamic added mass upon vertical movement. For long piles a frequency range of b 0.5 Hz to 25 Hz is useful, while for shorter piles a frequency up to about 300 Hz is useful.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for driving a pile which has an upper end, comprising:

determining one of three lowest resonant frequencies of said pile;

applying time-spaced shocks to the upper end of said pile, wherein the duration of each shock is between 0.4 and 1.8 times the period of said one resonant frequency, and the time between shocks is at least as great as the duration of each shock.

2. The method described in claim 1 wherein:

the critical damping ratio of said pile is less than 0.5, and the duration of each of said shocks is about 0.8 times the period of said resonant frequency.

3. The method described in claim 1 wherein:

said step of applying includes applying shock waves that each comprise substantially the first 180° of a sinuisoidal wave, whose amplitude varies sinusoidally with time.

4. The method described in claim 1 wherein:

said method of determining a resonant frequency includes determining the resonant frequency after the application of each shock, and said step of applying includes applying shocks whose duration is between 0.5 and 1.4 times the period of one of said resonant frequencies determined after the application of a previous shock.

5. Apparatus for driving a pile which has an upper end, comprising:

sensor means for detecting the lowest resonant frequency of said pile;

means for applying a plurality of shocks at spaced times, to the upper end of said pile, with each shock having a duration of between 0.4 and 1.8 times the period of said lowest resonant frequency, and with the shocks spaced by time periods greater than the duration of the shocks.

6. The apparatus described in claim 5 wherein:

said means for applying applies said shock waves so each comprises substantially the positive 180° of a sinusoidal wave.

7. The apparatus described in claim 5 wherein:

said means for applying shocks includes a hydraulic actuator coupled to said pile upper end, said actuator including a cylinder and a piston slidably in said cylinder, a source of pressured hydraulic fluid, a controllable valve which couples said source to said cylinder, and circuit means for controlling said valve to open and close it to control the duration of said shocks;

said sensor means is coupled to said pile to sense a resonant frequency of said pile upon the application of a shock thereto;

said circuit means is coupled to said sensor means, and said circuit means is constructed to alter the duration of said shocks as said resonant frequency of said pile changes.

8. A method for determining a resonant frequency of a pile comprising:

applying a varying force F to an upper portion of said pile at each of a plurality of frequencies to vibrate the pile;

measuring said force F applied to the pile and the velocity V of the pile substantially at the location where the force is applied;

determining a frequency where the ratio F/V is a minimum, to thereby determine a resonant frequency of the pile.

9. A method for driving a pile underwater, comprising:

positioning a hydraulic actuator above the top of said pile, wherein said actuator includes a piston with a lower end bearing against the top of said pile, and a hydraulic cylinder slidably receiving said piston and having an inlet for receiving high pressure hydraulic fluid for pushing said piston and an outlet for discharging hydraulic fluid;

establishing a reaction mass means for resisting acceleration, at said cylinder to resist upward acceleration of the cylinder;

applying pressured hydraulic fluid in pulses to said inlet and discharging fluid from said outlet;

said step of establishing reaction mass means includes coupling an underwater collar, of larger area, when viewed in a plan view, than said cylinder to resist cylinder movement in water.

10. Apparatus for driving a pile into the floor of a sea, wherein the upper end of the pile lies deeply below the sea surface, comprising:

a hydraulic actuator lying underwater, including a cylinder and a piston slidable with respect to said cylinder and coupled to the upper end of said pile;

a source of pressured hydraulic fluid, a controllable valve coupling said source to said actuator; and reaction mass means lying underwater and coupled to said cylinder to resist largely vertical movement of said cylinder;

said reaction mass means includes a collar lying underwater and coupled to said cylinder, said collar having a larger area when viewed in a plan view, than said cylinder, and oriented to resist vertical movement in the water.

* * * * *